US010961014B2

(12) United States Patent
Tart

(10) Patent No.: US 10,961,014 B2
(45) Date of Patent: Mar. 30, 2021

(54) CARTON WITH LINER

(71) Applicant: Graphic Packaging International, LLC, Atlanta, GA (US)

(72) Inventor: Christopher Tart, Leicestershire (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 16/377,755

(22) Filed: Apr. 8, 2019

(65) Prior Publication Data

US 2019/0308766 A1 Oct. 10, 2019

Related U.S. Application Data

(60) Provisional application No. 62/654,796, filed on Apr. 9, 2018.

(51) Int. Cl.
*B65D 5/60* (2006.01)
*B65D 5/36* (2006.01)
(Continued)

(52) U.S. Cl.
CPC ..... *B65D 5/606* (2013.01); *B65D 5/3628* (2013.01); *B65D 5/4204* (2013.01); *B65D 5/4608* (2013.01); *B65D 5/4612* (2013.01)

(58) Field of Classification Search
CPC .... B65D 5/606; B65D 5/3628; B65D 5/4204; B65D 5/4608; B65D 5/4612; B65D 5/40;
(Continued)

(56) References Cited

U.S. PATENT DOCUMENTS

D115,651 S 7/1939 Ford et al.
D120,673 S 5/1940 Jung
(Continued)

FOREIGN PATENT DOCUMENTS

| | | |
|---|---|---|
| EP | 0 639 504 | 2/1995 |
| GB | 889 718 | 2/1962 |
| SE | 140 388 | 5/1953 |

OTHER PUBLICATIONS

International Search Report and Written Opinion for PCT/US2019/026290 dated Jul. 24, 2019.
(Continued)

*Primary Examiner* — Christopher R Demeree
(74) *Attorney, Agent, or Firm* — Womble Bond Dickinson (US) LLP

(57) ABSTRACT

A reinforced package comprising a carton comprising a front panel, a first side panel foldably connected to the front panel along a first fold line, a back panel foldably connected to at least the first side panel along a second fold line, and a second side panel foldably connected to at least one of the front and back panels. A bag is at least partially attached to the carton. An access feature can be selectively opened for receiving products into the interior space of the bag. The access feature extends in at least a portion of the carton and the bag. The carton can be positionable in a non-erect position wherein the interior space of the bag is at least partially collapsed and in an erect position wherein the interior space of the bag is increased. The first side panel and the second side panel comprise retention features for retaining the carton in the erect position.

65 Claims, 13 Drawing Sheets

(51) Int. Cl.
*B65D 5/46* (2006.01)
*B65D 5/468* (2006.01)
*B65D 5/42* (2006.01)

(58) Field of Classification Search
CPC ..... B65D 5/4208; B65D 77/062; B31B 2120/25; B31B 2105/00; B67D 3/0067
USPC ..... 229/117.27, 117.3, 117.13, 117.14, 229/117.31, 117.35; 493/94; 383/119
See application file for complete search history.

(56) References Cited

U.S. PATENT DOCUMENTS

| | | | |
|---|---|---|---|
| 2,348,378 | A | 5/1944 | Goodyear |
| 2,586,301 | A | 2/1952 | Castle |
| 2,794,585 | A | 6/1957 | Wagner |
| D187,756 | S | 4/1960 | Storz |
| 3,013,710 | A | 12/1961 | Kronson et al. |
| 3,257,027 | A | 6/1966 | Weiss |
| 3,640,380 | A | 2/1972 | Huffman |
| D242,901 | S | 1/1977 | Lohrbach |
| 4,007,869 | A | 2/1977 | Stolkin et al. |
| D251,935 | S | 5/1979 | Ikezaki |
| 4,238,069 | A | 12/1980 | Morris, Jr. |
| 4,397,393 | A | 8/1983 | Pergande et al. |
| 4,530,459 | A | 7/1985 | Maroszek |
| 4,601,390 | A | 7/1986 | Rosenthal et al. |
| D319,388 | S | 8/1991 | McIntosh, Jr. et al. |
| 5,299,734 | A | 4/1994 | Lane |
| 5,400,901 | A | 3/1995 | Harrelson |
| D365,022 | S | 12/1995 | Wada |
| 5,501,335 | A | 3/1996 | Harris |
| 5,524,814 | A | 6/1996 | Davis |
| D373,079 | S | 8/1996 | Fahlen |
| 5,551,556 | A | 9/1996 | Sutherland |
| 5,595,291 | A | 1/1997 | Negelen |
| D386,680 | S | 11/1997 | Johnson |
| D407,970 | S | 4/1999 | Planchard |
| 5,950,912 | A | 9/1999 | Economopoulos |
| 6,439,452 | B1 | 8/2002 | Tsao |
| 6,530,516 | B1 | 3/2003 | Ritter |
| D496,273 | S | 9/2004 | Lenz |
| D523,483 | S | 6/2006 | Sparkowski |
| D525,866 | S | 8/2006 | Oliveira |
| D532,690 | S | 11/2006 | Oliveira |
| D582,263 | S | 12/2008 | Smith |
| 7,617,969 | B2 | 11/2009 | Oliveira |
| D616,739 | S | 6/2010 | Kalberer |
| D695,101 | S | 12/2013 | Keberlein |
| D712,735 | S | 9/2014 | McCracken |
| D733,549 | S | 7/2015 | Sanfilippo |
| 9,073,658 | B2 * | 7/2015 | Spivey, Sr. ..... B65D 5/00 |
| 9,248,933 | B2 * | 2/2016 | Spivey, Sr. ..... B65D 5/46088 |
| D764,288 | S * | 8/2016 | Simonetti ..... D9/432 |
| 9,463,896 | B2 | 10/2016 | Fitzwater |
| 9,771,176 | B2 | 9/2017 | Kastanek et al. |
| 9,969,523 | B2 * | 5/2018 | Ayerst ..... B65D 5/5405 |
| 10,023,349 | B2 | 7/2018 | Fitzwater |
| D826,711 | S * | 8/2018 | Boersma ..... B65D 5/0209 D9/432 |
| 10,173,805 | B2 | 1/2019 | Waddington |
| D839,729 | S | 2/2019 | Oliveira |
| D840,802 | S | 2/2019 | van Dijk |
| D850,907 | S | 6/2019 | Moberg |
| 10,322,840 | B2 * | 6/2019 | Angulo ..... B65D 71/36 |
| D858,912 | S | 9/2019 | van Halder |
| 2003/0213705 | A1 | 11/2003 | Woog |
| 2006/0091190 | A1 | 5/2006 | Nikolai |
| 2006/0097005 | A1 * | 5/2006 | Hill ..... B65D 5/5035 222/105 |
| 2006/0180643 | A1 | 8/2006 | Stephenson |
| 2008/0277417 | A1 * | 11/2008 | Groesbeck ..... B65D 5/4204 222/105 |
| 2010/0124386 | A1 | 5/2010 | Sturgis |
| 2010/0270367 | A1 | 10/2010 | Brandenburger |
| 2011/0163154 | A1 * | 7/2011 | Gordon ..... B65D 81/368 229/116.1 |
| 2015/0217897 | A1 | 8/2015 | Fitzwater |
| 2016/0325877 | A1 | 11/2016 | Kastanek et al. |

OTHER PUBLICATIONS

Integraflex to deliver a user friendly compact pack. [online] Retrieved Sep. 5, 2019 from URL: https://www.packagingworldinsights.com/food/integraflex-an-innovative-new-packaging-solution-by-graphic-packaging-international/.

* cited by examiner

CARTON WITH LINER

CROSS-REFERENCE TO RELATED APPLICATIONS

This application claims the benefit of U.S. Provisional Patent Application No. 62/654,796, filed on Apr. 9, 2018.

INCORPORATION BY REFERENCE

The disclosures of U.S. Provisional Patent Application No. 62/654,796, filed Apr. 9, 2018, U.S. patent application Ser. No. 15/630,061, filed Jun. 22, 2017, U.S. Provisional Patent Application No. 62/354,270, filed Jun. 24, 2016, U.S. patent application Ser. No. 15/217,026, filed Jul. 22, 2016, U.S. Provisional Patent Application No. 62/282,049, filed Jul. 23, 2015, U.S. patent application Ser. No. 14/496,252, filed Sep. 25, 2014, U.S. Provisional Patent Application No. 61/960,712, filed on Sep. 25, 2013, U.S. patent application Ser. No. 15/209,013, filed Jul. 13, 2016, and U.S. Provisional Patent Application No. 62/231,723, filed on Jul. 14, 2015, are hereby incorporated by reference for all purposes as if presented herein in their entirety.

BACKGROUND OF THE DISCLOSURE

The present disclosure generally relates to reinforced packages for receiving and/or holding products and to methods of forming the packages. More specifically, the present disclosure is directed to a package including a bag or liner attached to a carton or blank having features to reinforce the shape of the formed package and allow the package to receive products, and features that facilitate forming the package and keeping the package open.

SUMMARY OF THE DISCLOSURE

In general, one aspect of the disclosure is generally directed to a reinforced package comprising a carton comprising a plurality of panels that extends at least partially around an interior of the carton. The plurality of panels can comprise a front panel, a first side panel foldably connected to the front panel along a first fold line, a back panel foldably connected to at least the first side panel along a second fold line, and a second side panel foldably connected to at least one of the front panel and the back panel. A bag can be at least partially attached to the carton at least partially in the interior of the carton, and the bag can comprise an interior space. An access feature can be selectively opened for receiving products into the interior space of the bag. The access feature can extend in at least a portion of the carton and in at least a portion of the bag. The carton can be positionable in a non-erect position wherein the interior space of the bag is at least partially collapsed and in an erect position wherein the interior space of the bag is increased, and the carton can be configured to support the bag in the erect position. The first side panel and the second side panel can comprise retention features for at least partially retaining the carton in the erect position.

In another aspect, the disclosure is generally directed to, in combination, a carton blank and a bag for forming a reinforced package for holding a product. The carton blank can be for forming a carton. The carton blank can comprise a plurality of panels comprising a front panel, a first side panel foldably connected to the front panel along a first fold line, a back panel foldably connected to at least the first side panel along a second fold line, and a second side panel foldably connected to at least one of the front panel and the back panel. The bag can be at least partially attached to the carton blank, and the bag can comprise an interior space. An access feature can be selectively opened for receiving products into the interior space of the bag when the reinforced package is formed from the carton blank and the bag, and the access feature can extend in at least a portion of the carton blank and in at least a portion of the bag. The carton formed from the carton blank can be positionable in a non-erect position wherein the interior space of the bag is at least partially collapsed and in an erect position wherein the interior space of the bag is increased. The first side panel and the second side panel can comprise retention features for at least partially retaining the carton formed from the carton blank in the erect position.

In another aspect, the disclosure is generally directed to a method of forming a reinforced package. The method can comprise obtaining a carton blank at least partially attached to a bag. The carton blank can comprise a plurality of panels comprising a front panel, a first side panel foldably connected to the front panel along a first fold line, a back panel foldably connected to at least the first side panel along a second fold line, and a second side panel foldably connected to at least one of the front panel and the back panel. The bag can comprise an interior space. An access feature can extend in at least a portion of the carton blank and in at least a portion of the bag. The method further can comprise forming an interior of a carton at least partially defined by the plurality of panels by folding the plurality of panels at least partially around the bag. The carton can be positionable in a non-erect position wherein the interior space of the bag is at least partially collapsed and in an erect position wherein the interior space of the bag is increased, and the carton can be configured to support the bag in the erect position. The first side panel and the second side panel can comprise retention features for at least partially retaining the carton in the erect position. The access feature can be selectively opened for receiving products into the interior space of the bag.

Other aspects, features, and details of the present disclosure can be more completely understood by reference to the following detailed description of exemplary embodiment taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Figure 3:
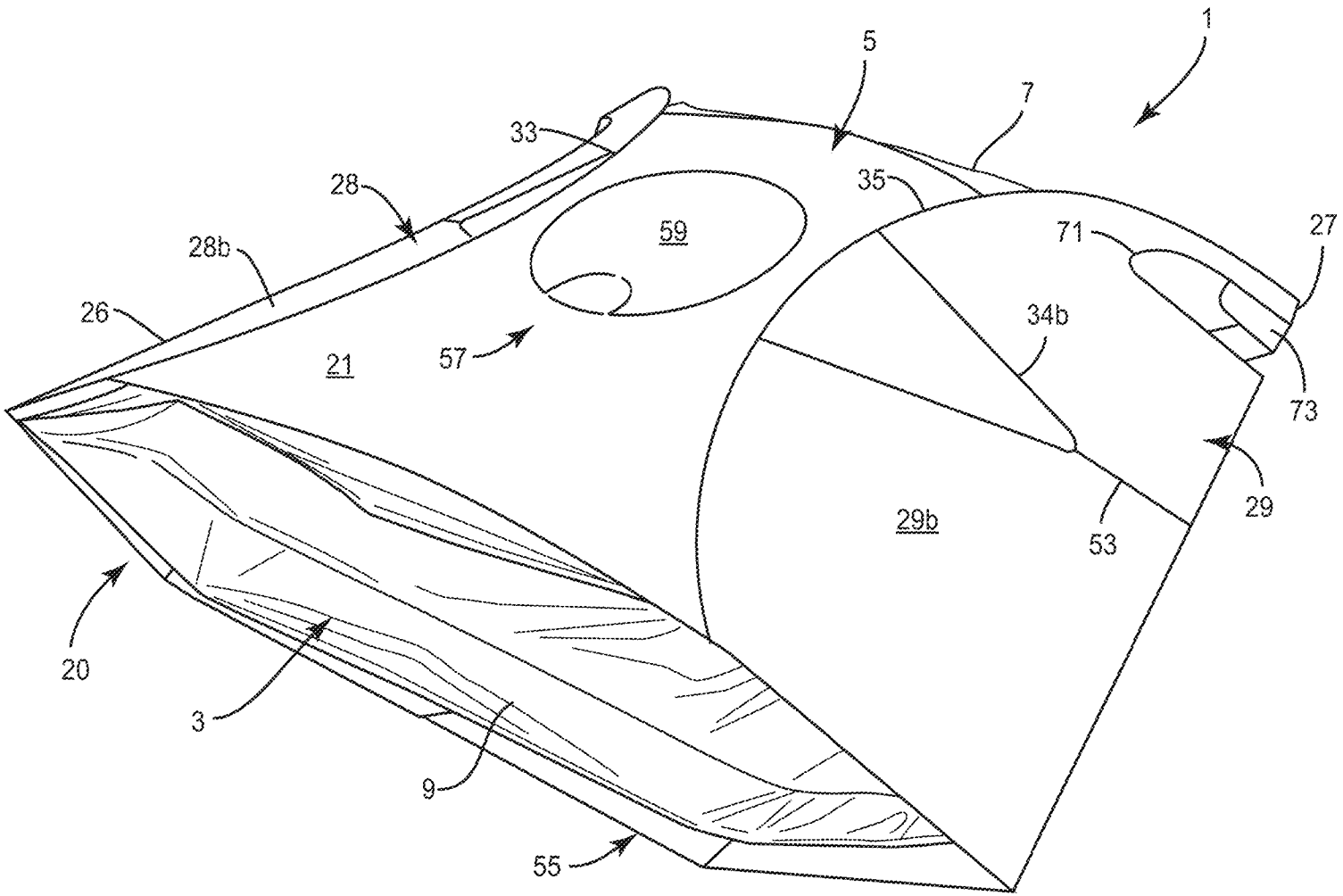
FIG. 3 is an exterior plan view showing a package including the bag formed from the web portion of FIG. 2 attached to the interior of the carton formed from the blank of FIG. 1, the package being in a collapsed configuration according to the first exemplary embodiment of the disclosure.
Figure 4:
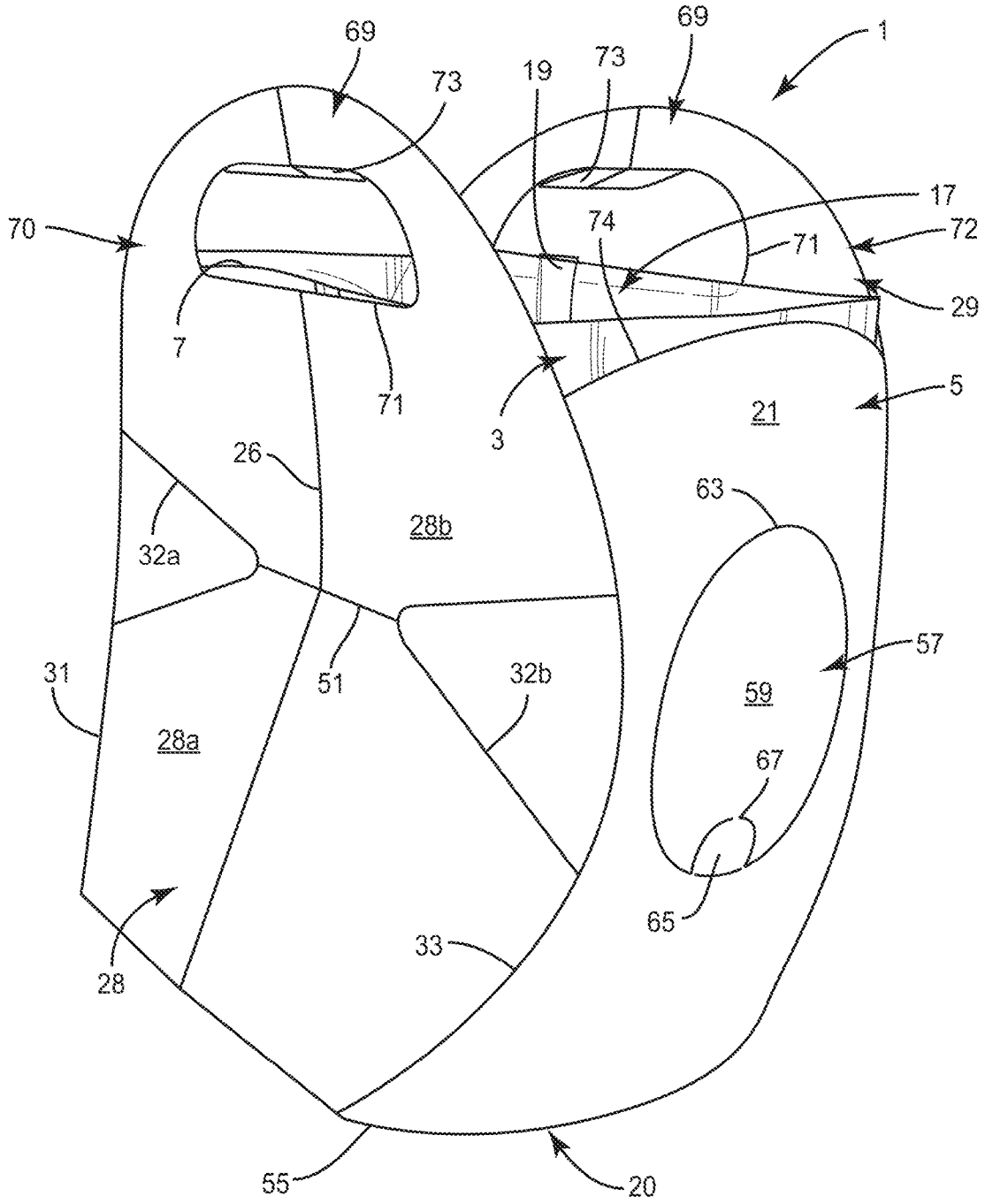
Figure 5:
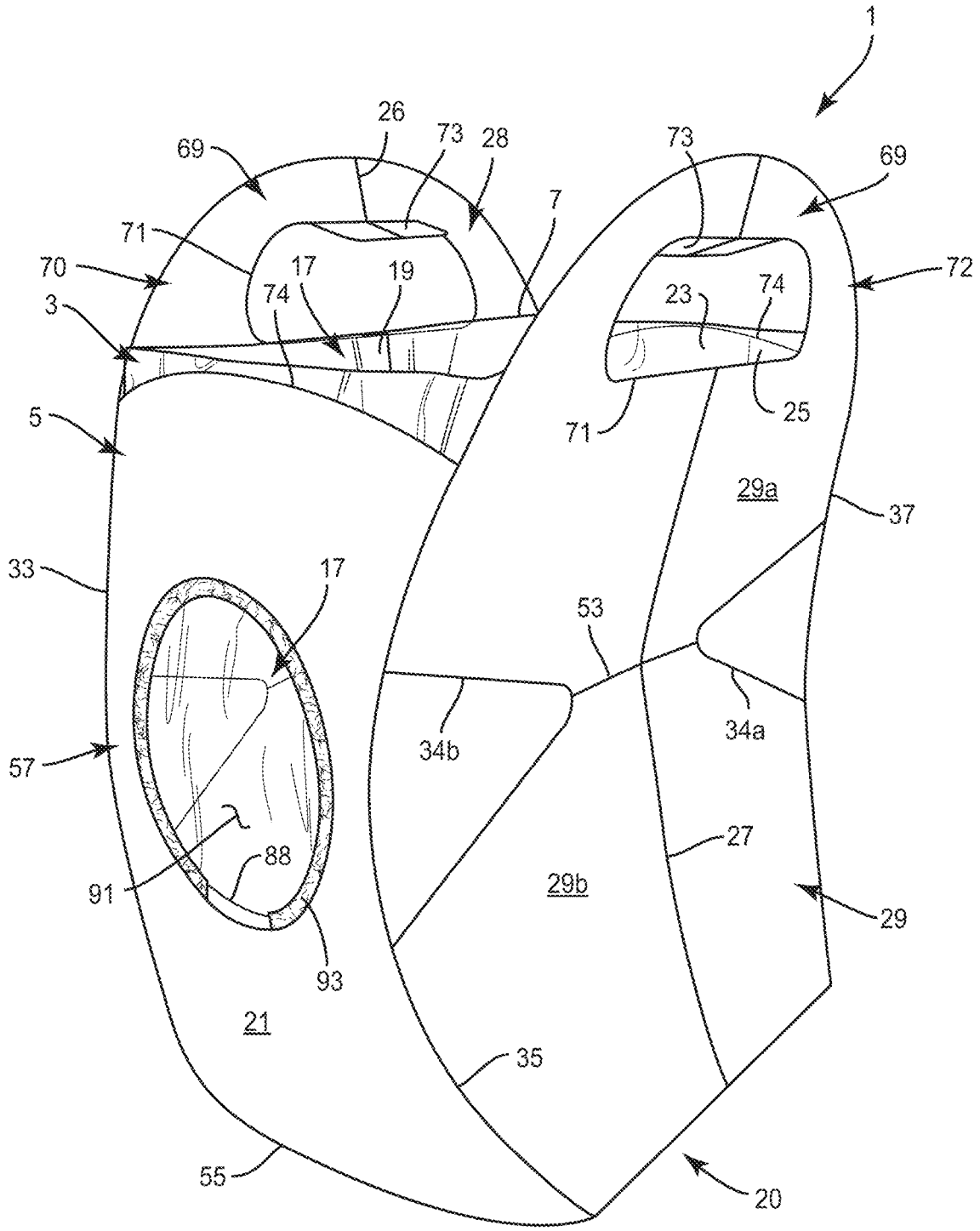

FIGS. 4 and 5 are perspective views of the package of FIG. 3 in an erected configuration according to the first exemplary embodiment of the disclosure.

Figure 6:
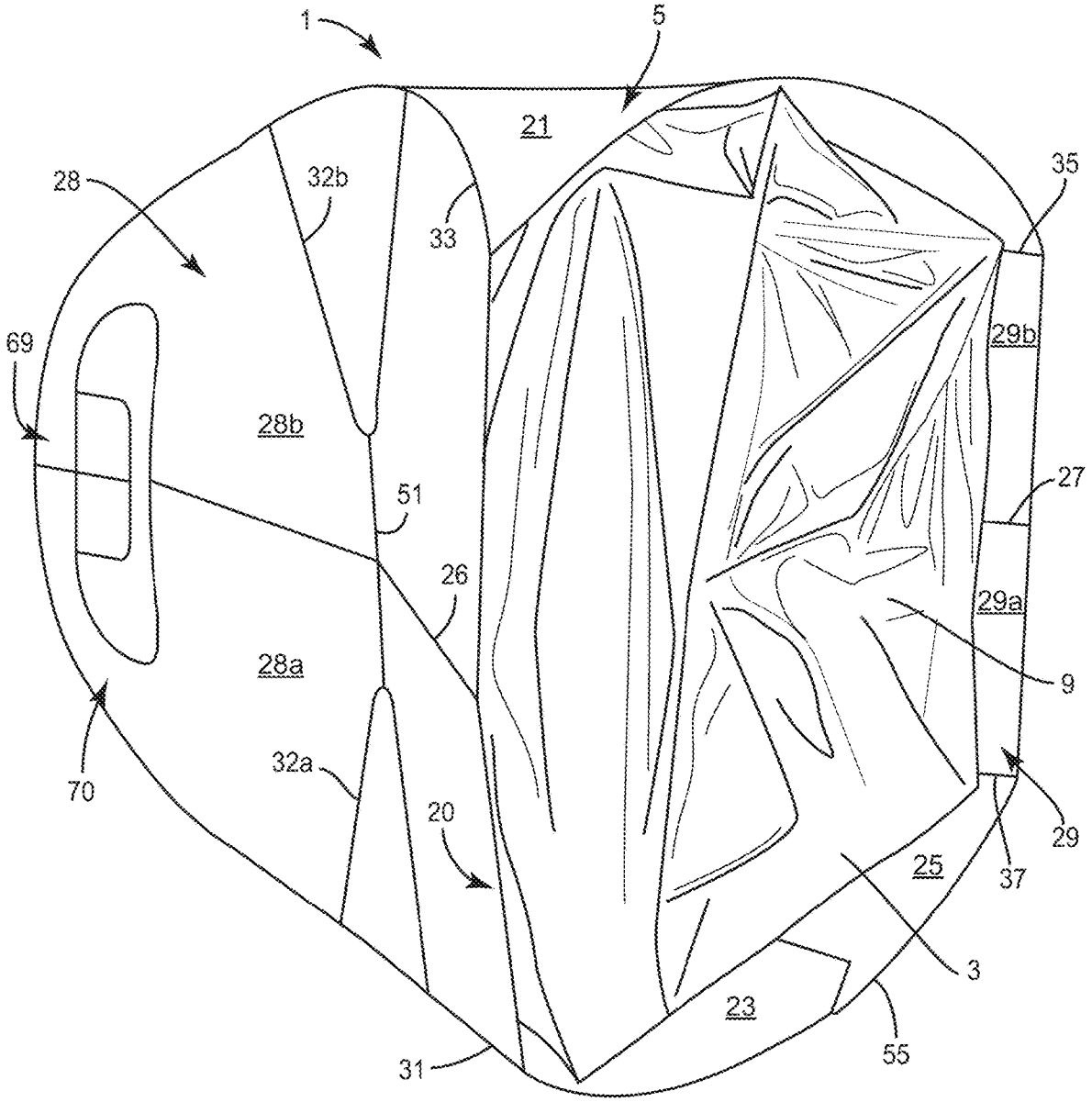

FIG. 6 is a perspective bottom view of the package of FIGS. 4 and 5.

Figure 7:
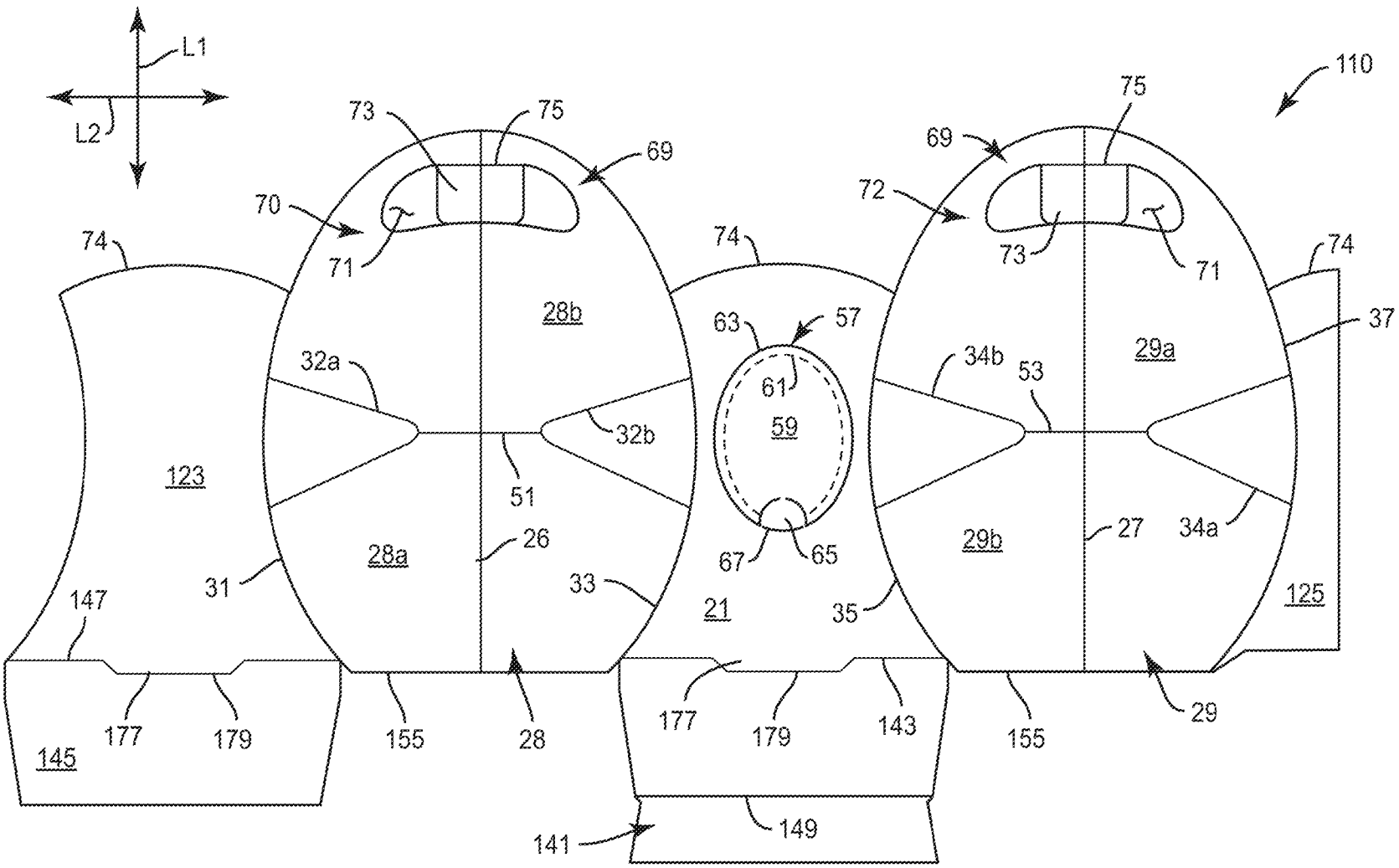

FIG. 7 is an exterior plan view of a blank used to form a carton of a package according to a second exemplary embodiment of the disclosure.

Figure 2:
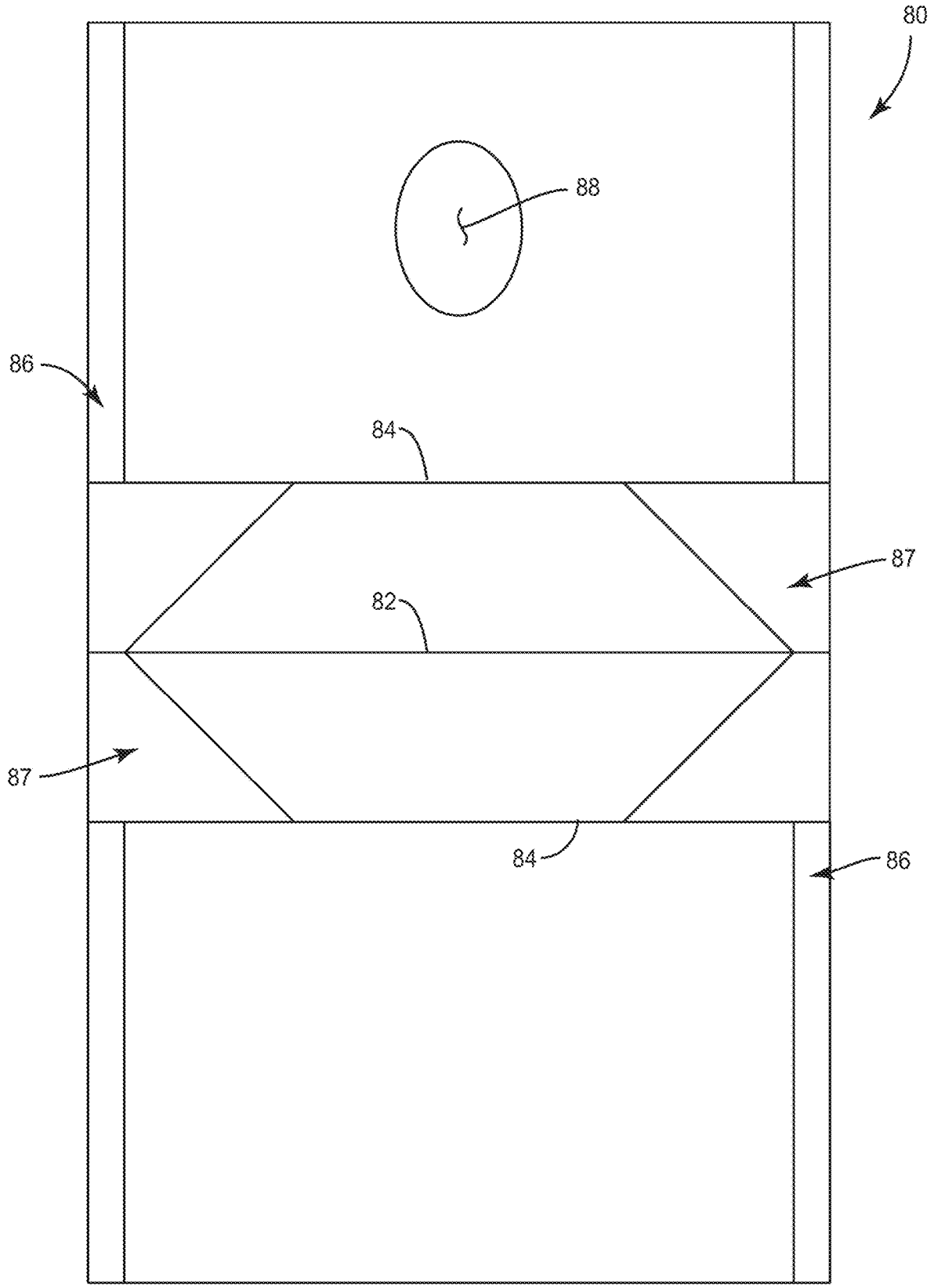
FIG. 2 is a plan view of a portion of a web for forming a bag of the package according to the first exemplary embodiment of the disclosure.
Figure 8:
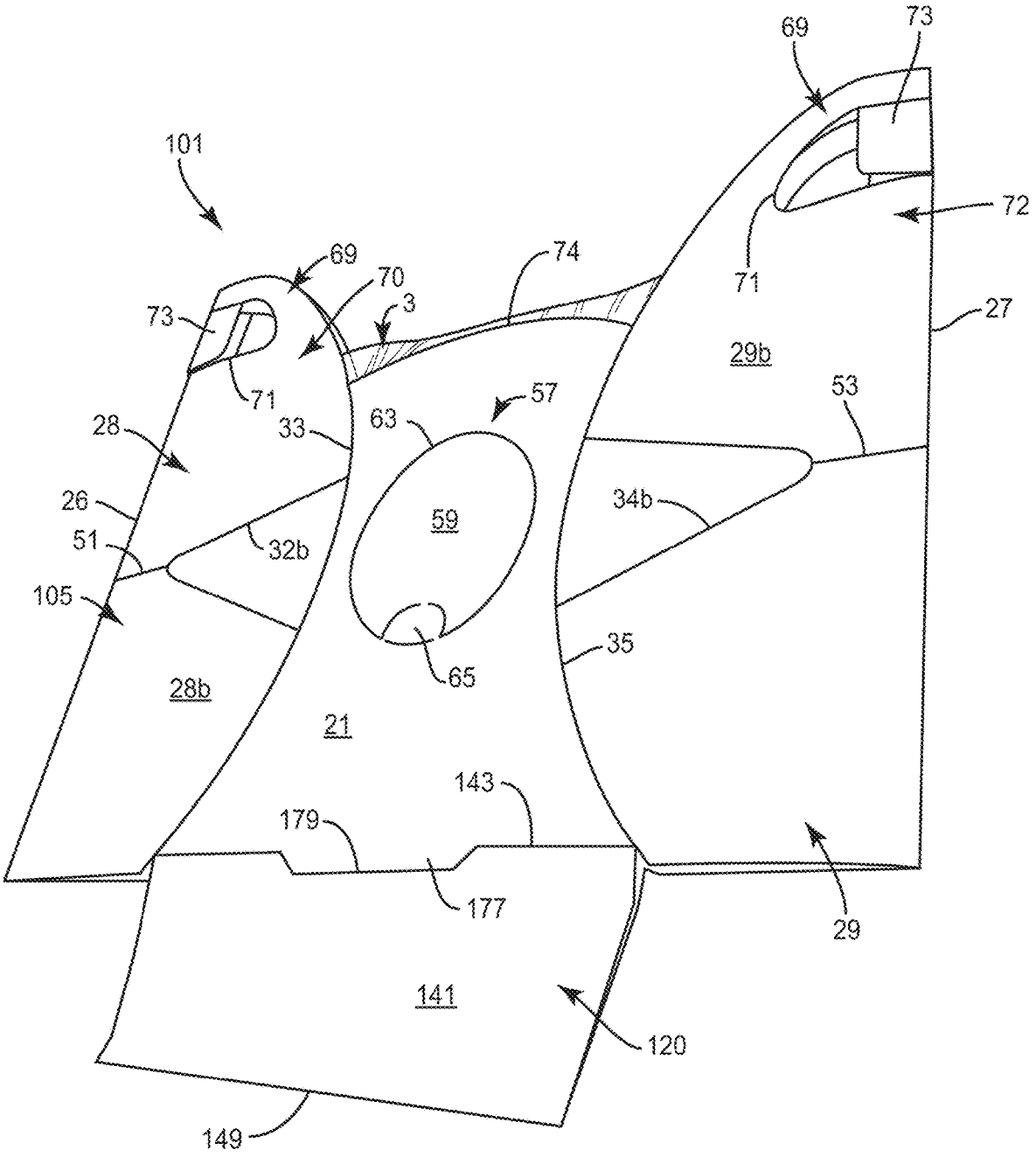

FIG. 8 is an exterior plan view showing a package including the bag formed from the web portion of FIG. 2 attached to the interior of the carton formed from the blank of FIG. 7, the package being in a collapsed configuration according to the second exemplary embodiment of the disclosure.

Figure 9:
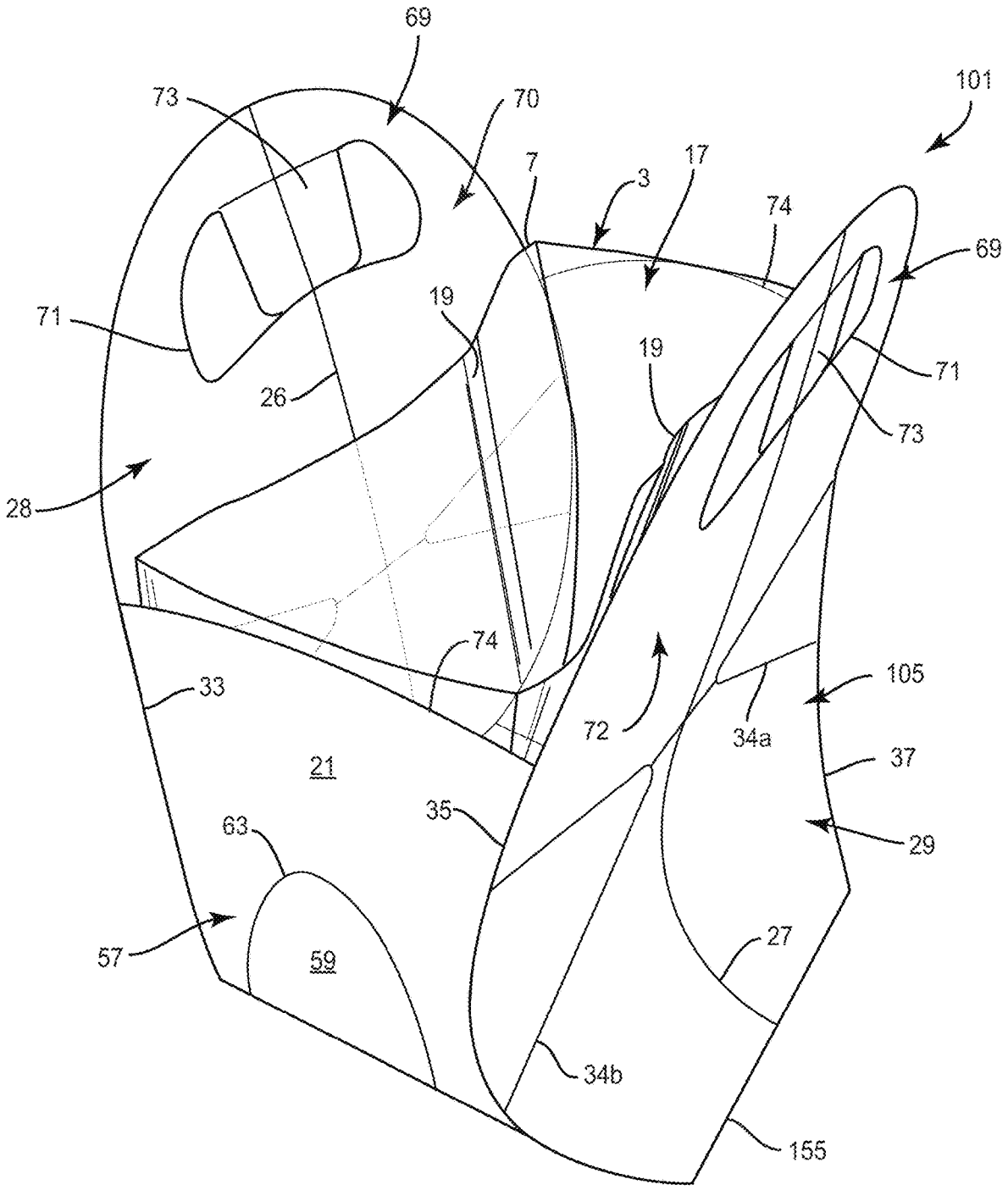
Figure 10:
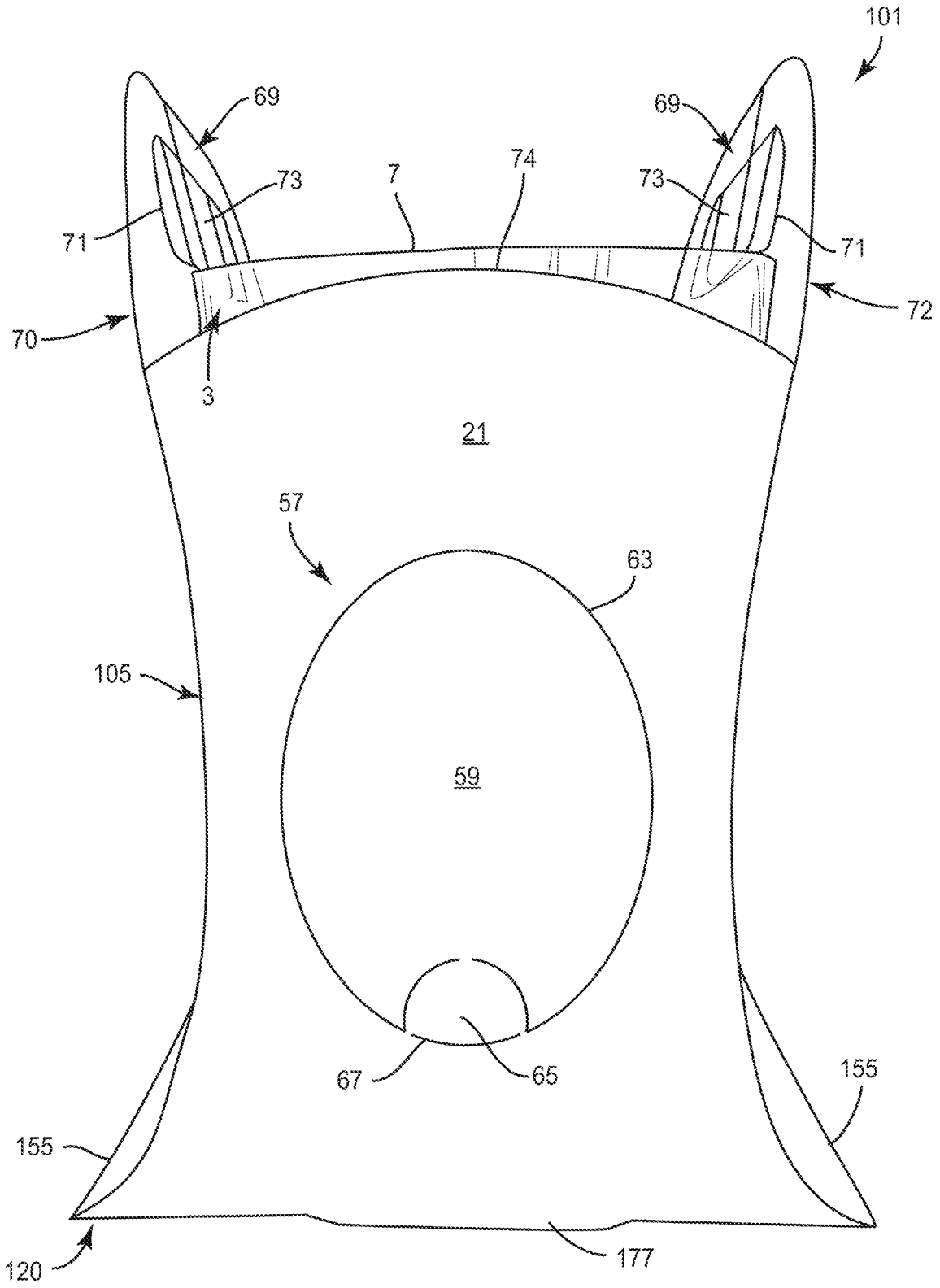

FIGS. 9 and 10 are perspective views of the package of FIG. 8 in an erected configuration according to the second exemplary embodiment of the disclosure.

Figure 11:
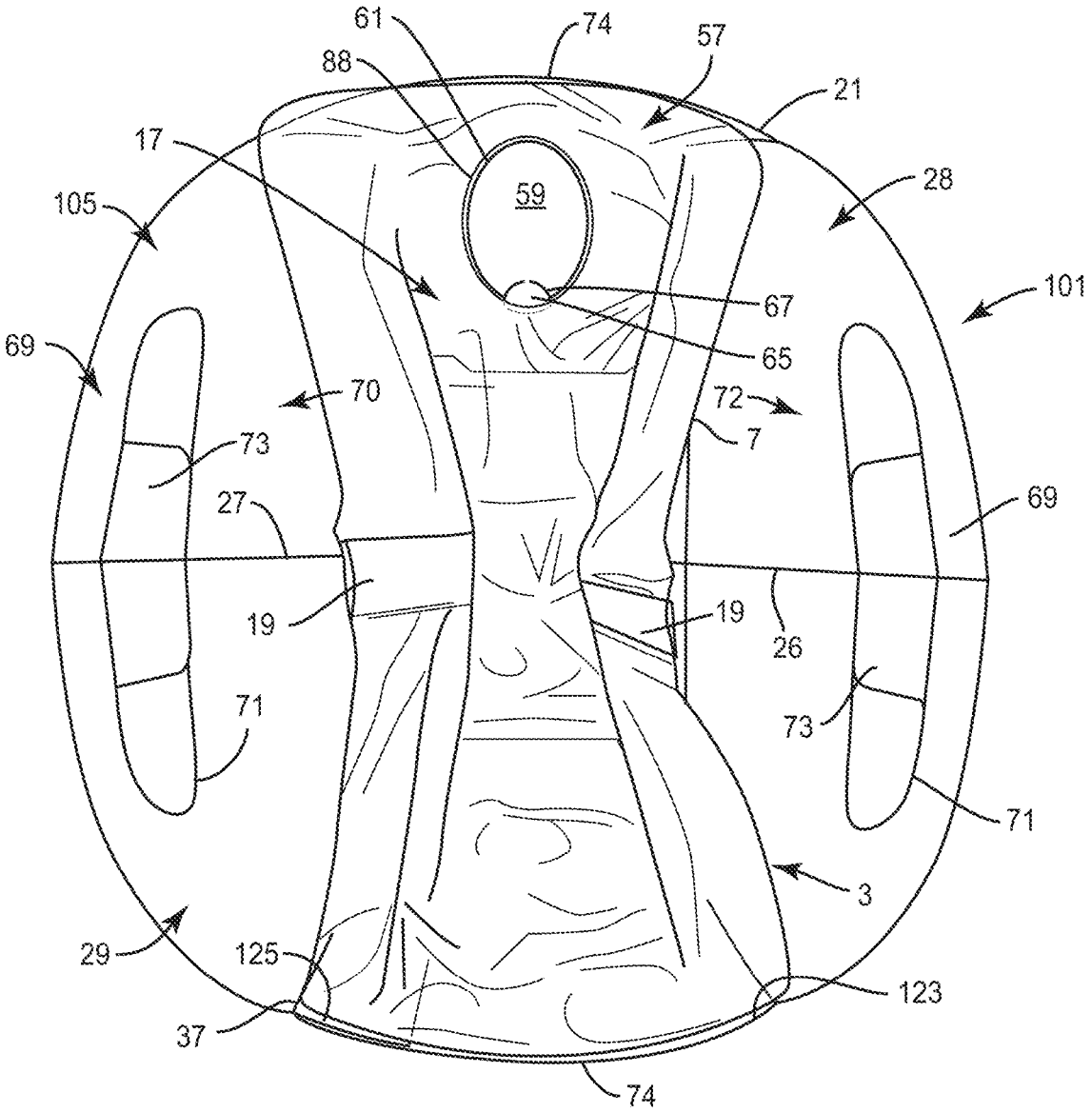

FIG. 11 is a top view of the package of FIGS. 9 and 10.

Figure 12:
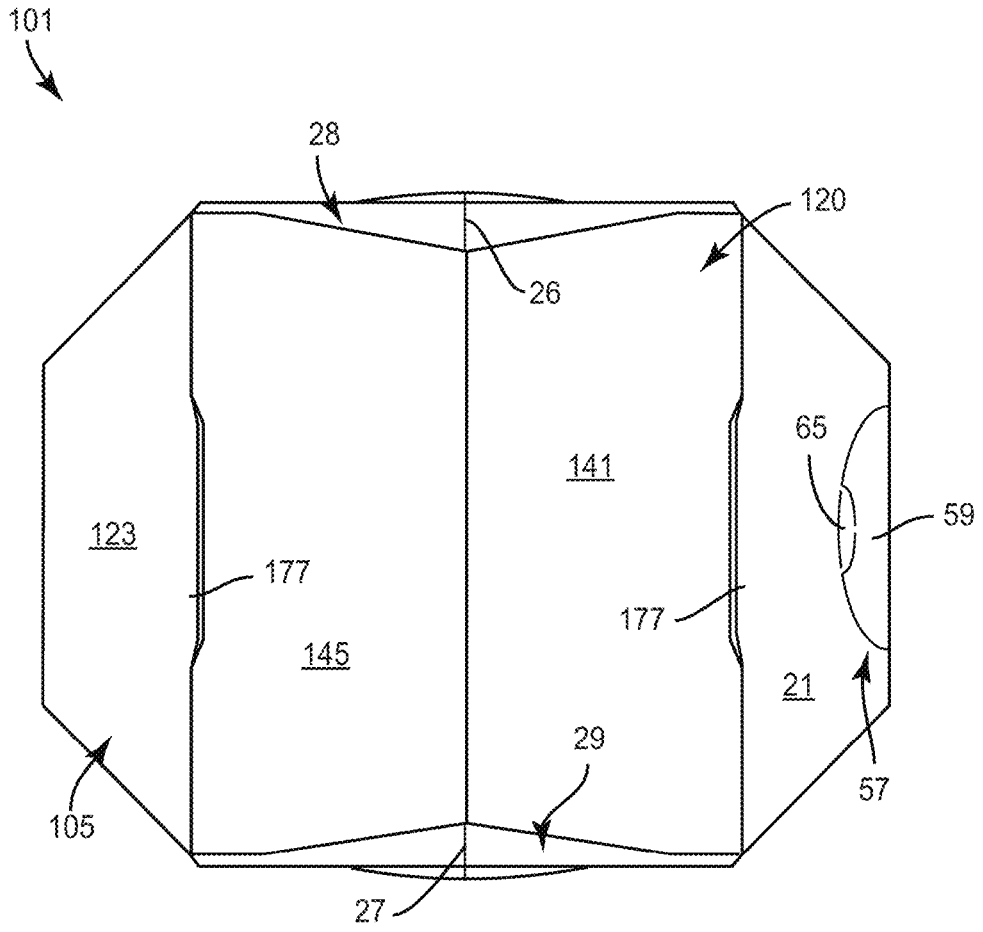

FIG. 12 is a bottom view of the package of FIGS. 9 and 10.

Figure 13:
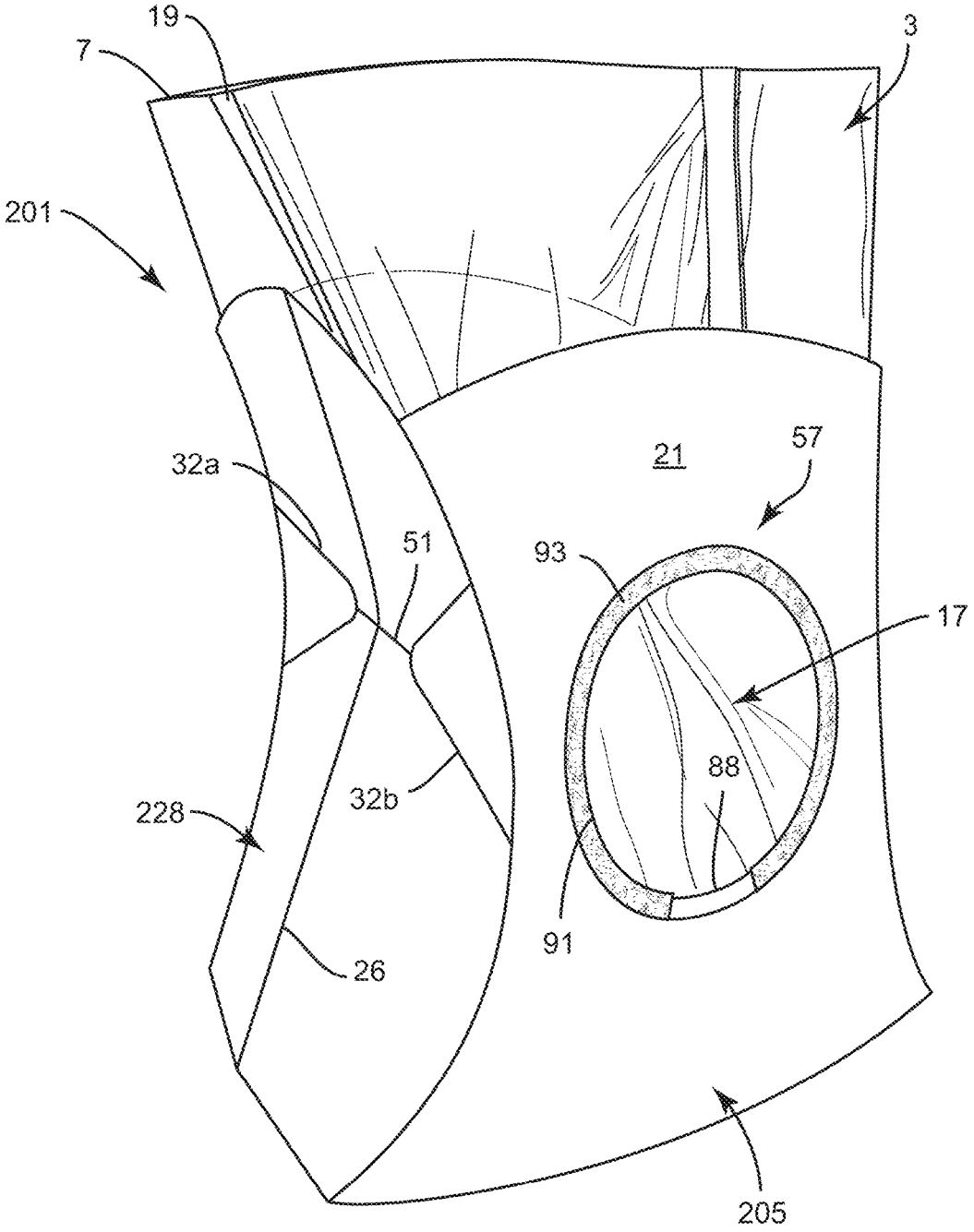

FIG. 13 is a perspective view of a package in an erected configuration according to a third exemplary embodiment of the disclosure.

Corresponding parts are designated by corresponding reference numbers throughout the drawings.

DETAILED DESCRIPTION OF THE EXEMPLARY EMBODIMENTS

The present disclosure generally relates to a reinforced package for receiving and/or holding products such as waste products (e.g., human waste products) or other items. Packages according to the present disclosure can accommodate fluids (e.g., liquids) and/or solid articles of any shape. The packages can comprises a bag, liner, or wrap material comprising a relatively flexible material attached to a reinforcing construct comprising a relatively rigid material (e.g., paperboard). The bags or liners can generally be made from a paper, plastic or other stock material and can be attached to the reinforcing construct. In one embodiment, the liners comprise polyethylene material or any other suitable heat-sealable material. The reinforcing construct can be of varying widths and can extend about or over the closed ends of the bags, in some embodiments enclosing such closed ends, and will provide support for the bags upon receiving a product or article or series of articles therein. In some embodiments, the reinforcing construct can be folded with their bags into a configuration supporting the bags in a freestanding, upright and opened condition for ease of use.

Figure 1:
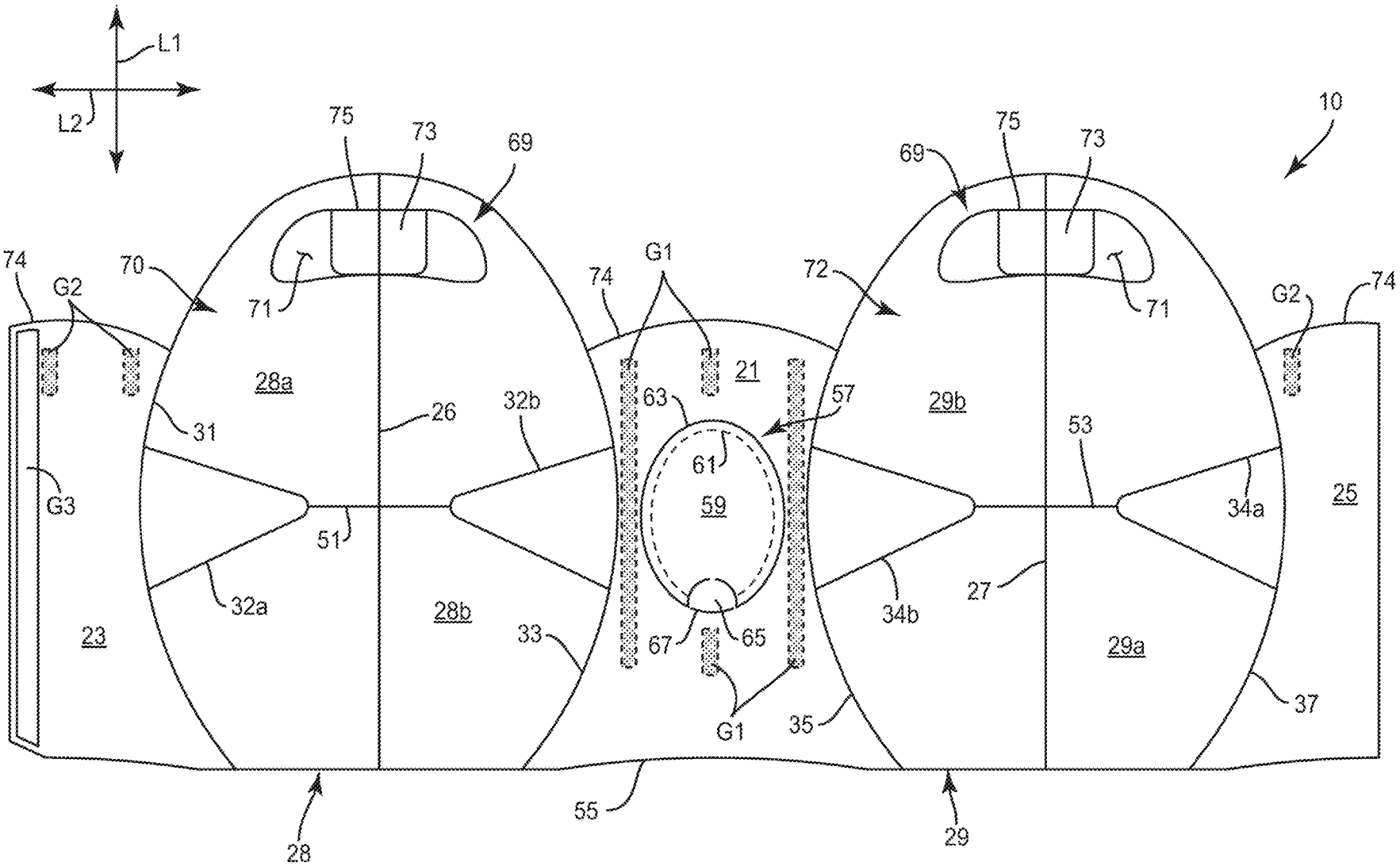
FIG. 1 is an exterior plan view of a blank used to form a carton of a package according to a first exemplary embodiment of the disclosure.

FIG. 1 illustrates a blank 10 for forming a reinforced package generally indicated at 1 (FIGS. 3-6), that includes a bag 3 attached to a carton 5 according to one embodiment of the disclosure. The bag 3 has an open top end 7 (FIGS. 4 and 5), a closed or sealed bottom end 9 (FIGS. 3 and 6), and an interior space 17 (FIGS. 4 and 5) for receiving and/or holding a product. In one embodiment, the bag 3 has sealed sides 19 (FIGS. 4 and 5) extending the length of the bag between the top 7 and bottom 9. In some embodiments, the top end 7 of the bag 3 can be sealed or closed. The carton 5 has other features as further described herein to reinforce the package 1 by increasing the rigidity of the package 1 and to lock the package in the formed state of FIGS. 4-7. The carton 5 can facilitate shipping the package 1 in a flat configuration and forming the package 1 and keeping the package 1 open to allow the package to receive products in the interior space 17 of the bag 3. Further, the carton 5 has support features for allowing the package 1 to be positioned in the upright position of FIGS. 4-6.

As shown in FIG. 1, the blank 10 has a lateral axis L1 and a longitudinal axis L2. In the illustrated embodiment, the blank 10 has a front panel 21 foldably connected to a first side panel 28 at a first fold line 33. The first side panel 28 includes two individual panel portions 28*a*, 28*b* foldably connected to one another at lateral fold line 26. A first back panel 23 is foldably connected to the first side panel 28 at a second fold line 31. A second side panel 29 is foldably connected to the front panel 21 at a third fold line 35. The second side panel 29 includes two individual panel portions 29*a*, 29*b* foldably connected to one another at lateral fold line 27. An attachment flap or second back panel 25 is foldably connected to the second side panel 29 at a fourth fold line 37. Any of the front panel 21, the back panels 23, 25, and/or the side panels 28, 29 could be omitted or could be otherwise arranged, shaped, positioned, and/or configured without departing from the disclosure. Also, the blank 10 could include one or more bottom flaps and/or panels for at least partially closing the bottom of the carton 5.

In one embodiment, the panel portions 28*a*, 28*b* of the first side panel 28 include a longitudinal fold line 51 extending between respective V-shaped fold lines 32*a*, 32*b* that abut the respective fold lines 31, 33. As shown in FIG. 1, the longitudinal fold line 51 extends from the vertex of the V-shaped fold line 32*a* to the vertex of the V-shaped fold line 32*b* and intersects with the lateral fold line 26. In the illustrated embodiment, the panel portions 29*a*, 29*b* of the second side panel 29 include a longitudinal fold line 53 extending between respective V-shaped fold lines 34*a*, 34*b* that abut the respective fold lines 37, 35. As shown in FIG. 1, the longitudinal fold line 53 extends from the vertex of the V-shaped fold line 34*a* to the vertex of the V-shaped fold line 34*b* and intersects with the lateral fold line 27. As shown in FIG. 1, the fold lines 31, 33 can be arcuate fold lines and can be concave with respect to the first side panel 28. Similarly, the fold lines 35, 37 can be arcuate and can be concave with respect to the second side panel 29. In one embodiment, each of the fold lines 31, 33, 35, 37 can be curved creases or any other suitable fold line (e.g., a cut-crease style fold line) and each can include an arcuate cut portion extending between the respective ends of the respective V-shaped fold lines 32*a*, 32*b*, 34*b*, 34*a*. Alternatively, the arcuate cut portions could be other suitable features (e.g., arcuate creases and/or alternatively shaped) without departing from the disclosure.

In one embodiment, the fold lines 26, 27, 31, 32*a*, 32*b*, 33, 34*a*, 34*b*, 35, 37, 51, and 53 comprise strengthening features of the blank that strengthen and reinforce the package 1 formed from the blank by increasing the rigidity of the sides of the carton 5. For example, in one embodiment, the strengthening features can help retain the package in the erected or expanded configuration shown in FIGS. 4-6 as described in more detail below. Any of the fold lines 26, 27, 31, 32*a*, 32*b*, 33, 34*a*, 34*b*, 35, 37, 51, 53 and the side panels 28, 29 could be omitted and/or could be otherwise arranged, shaped, positioned, and/or configured without departing from the disclosure.

In one embodiment, the blank 10 includes a lower edge 55, which can help support the formed package 1 on a surface in an upright position such that the open top end 7 of the bag 3 is accessible to provide access to the interior 17 of the bag.

As shown in FIG. 1, the blank 10 can include an access feature 57 extending in at least the front panel 21. In the illustrated embodiment, the access feature 57 can include an access panel 59 at least partially defined by scores 61, 63 in the front panel 21. In one embodiment, the score 61 can be an inner score formed in the interior surface of the front panel 21 (the score 61 is shown in phantom in FIG. 1) and the score 63 can extend at least partially around the score 61 and can be an outer score formed in the exterior surface of the front panel 21. For example, the score 61 can be a partial cut extending into the front panel from the interior surface of the front panel, and the score 63 can be a partial cut extending into the front panel 21 from the exterior surface of the front panel. Accordingly, the access panel 59 can be separable from the front panel 21 at an area of weakening formed by the scores 61, 63. An access flap 65 can be at least partially separable from the front panel 21 and/or the access panel 59 along a line 67 (e.g., a tear line, a cut line, a fold line, etc.). The access panel 59 can be separable from the front panel 21 along the scores 61, 63 for opening the access feature 57 for receiving a product. As shown in FIG. 1, the access feature 57 is generally in the shape of an oval with a long diameter extending in the lateral direction L2. The access feature 57 could be omitted or could be otherwise arranged, shaped, positioned, and/or configured without departing from the disclosure. The access panel 59 could be formed by features other than the scores 61, 63; the score 61 and/or score 63 could be otherwise shaped, arranged, configured, and/or omitted; or the access panel 59 could be otherwise shaped without departing from the disclosure. For example, the access panel 59 could be separable from the front panel 21 along any suitable line of weakening (e.g., a tear line).

In the illustrated embodiment, the blank 10 can include handles 69 extending in respective upper extensions or portions 70, 72 of the side panels 28, 29. As shown in FIG. 1, the upper portions 70, 72 of the side panels 28, 29 extend upwardly from the upper edges 74 of the front panel 21 and the back panels 23, 25. In one embodiment, the edges of the upper portions 70, 72 can be curved and can extend from respective ends of the fold lines 31, 33, 35, 37. Each of the handles 69 can include a handle opening 71 and a comfort flap 73 foldably connected to the respective side panel 28, 29 along a respective longitudinal fold line 75. As shown in FIG. 1, the handle openings 71 and the comfort flaps 73 of the handles 69 are positioned in the upper portions 70, 72 of the side panels 28, 29 so that the handles are spaced above the upper edges 74 of the front panel 21 and the back panels 23, 25. The handles 69 could be omitted or could be otherwise arranged, shaped, positioned, and/or configured without departing from the disclosure.

In one embodiment, the bag 3 (FIGS. 3-5) can be formed from similar methods and have similar features as the bag shown in U.S. Provisional Patent Application No. 62/231,723 filed Jul. 14, 2015, and U.S. patent application Ser. No. 15/209,013 filed Jul. 13, 2016, which are incorporated by reference herein. The bag 3 can be formed by a portion of suitable material 80 shown in FIG. 2 that has a central fold 82 and two outer folds 84 that form the gusseted bottom 9 of the bag 3 (FIGS. 3 and 6). In addition, the portion 80 of bag material can have two edge margins 86 extending along the length of the portion 80. As shown in FIG. 2, the edge margins 86 can extend into the gussets at widened portions 87, which can facilitate the formation of the gusseted bottom 9. When the gusseted bottom 9 of the bag 3 is formed, the central fold 82 and the two outer folds 84 form four layers of overlapped material at the bottom of the bag such that the bottom of the bag is expandable to accommodate various sizes of product to be received an/or held in the bag when the carton 5 is formed to the erected position of the package 1. The portion 80 of bag material is folded at the central fold 82 and outer folds 84 and the overlapping portions of the edge margins 86, 87 can be sealed together (e.g., heat sealed or otherwise secured together) to form the sealed sides 19 that extend into the bottom 9 of the bag so that the side portions of the overlapped layers of material in the bag 3 are sealed. In the flat configuration of the bag 3 (FIG. 3), the outer folds 84 form the lowermost edge of the bag. In one embodiment, the material for forming the bags 3 can include preprinted paper, polyethylene or other material including flexible and heat-sealable materials or any other suitable material for holding solids and/or fluids without departing from the disclosure.

As shown in FIG. 2, the access feature 57 can include an access aperture 88 extending in a front section of the web portion 80. In one embodiment, the access aperture 88 can be an oval that generally corresponds in shape and size to the access panel 59 in the front panel 21 of the blank 10. The access aperture 88 could be other shapes and/or sizes or could be otherwise positioned without departing from the disclosure. For example, the aperture 88 could be replaced by a tear-away panel (not shown) that is separable from the remainder of the web portion 80 along a tear line (not shown), wherein the tear-away panel could be attached to the access panel 59 and could be removed along the tear line (e.g., as the access panel 59 is removed) to form the aperture 88. The web portion 80 and/or bag 3 could be otherwise shaped, arranged, and/or configured without departing from the disclosure. Further, the bag 3 could be otherwise formed without departing from the disclosure.

In one embodiment, the reinforced package 1 can be formed by similar systems and methods as shown in one or more of the incorporated by reference patent applications, wherein the packaging system attaches a web of material for forming the bags 3 of the packages 1 to the blanks 10, and the blanks and web move through a respective packaging system and are formed into the individual packages by various portions and components of the system. The blanks 10 are formed into the reinforced cartons 5 and the web of material is formed into the bags 3, with respective portions 80 of the web of material being overlapped to form the bags. The reinforced packages 1 include the reinforced carton 5 having a bag 3 attached.

In one embodiment, one or more systems can form the bags 3 and attached the bags 3 to respective blanks 10, or the bags 3 could be formed after being attached to the blanks 10. The separated individual blanks 10 and attached bags 3 are conveyed in the system to a folder/gluer carton forming assembly that includes a series of folders that position the various flaps and panels of the blank 10 to form the flat cartons 5 that can be packaged and shipped for filling with product. In the illustrated embodiment, before or after the bag 3 is formed from the web portion 80, the front section can be attached to the front panel 21 of the blank 10 (e.g., at glue strips or glue areas G1 on the interior surface of the front panel 21 as shown in phantom in FIG. 1). In the illustrated embodiment, the access aperture 88 can be aligned with the access feature 57 so that the edges of the bag 3 adjacent the access aperture 88 are disposed adjacent the inner score 61 of the access feature 57. As shown in FIG. 1, the glue areas G1 can be arranged on the front panel 21 so that the bag 3 is attached to the front panel 21 at locations above and below the access feature 57 and at locations between the first side panel 28 and the access feature 57 and between the second side panel 29 and the access feature 57. Accordingly, the bag 3 can be attached to the front panel 21 in a manner that limits materials from leaking between the bag 3 and the front panel 21 at the aperture 88 when materials are entering the interior 17 of the bag 3 via the access feature 57. In an alternative embodiment, the bag 3 can be sealed along the entire perimeter of the access panel 59 and the access aperture 88 or along any suitable portion of the perimeter. The blank 10 can be folded along the lateral fold lines 26, 27 so that the back panel 23 and the attachment flap 25 at least partially overlap the bag 3 and the front panel 21. In addition, the side portions 28*a*, 29*a* can overlap the side portions 28*b*, 29*b* in the respective side panels 28, 29. In one embodiment, the bag 3 can be glued to the back panel 23 and the attachment flap 25 (e.g., by glue strips or glue areas G2 on the interior surfaces of the respective back panel 23 and attachment flap 25 as shown in phantom in FIG. 1). Accordingly, the bag 3 can be attached to front panel 21, the back panel 23, and the attachment flap 25 of the carton 5. In the illustrated embodiment, the attachment flap 25 can be overlapped with the back panel 23 and adhesively attached thereto (e.g., by glue in a glue area G3 on the interior surface of the back panel 23 as shown in phantom in FIG. 1). The package 1 could be otherwise formed without departing from the disclosure. For example, the bag 3 can be preformed from the web portion 80 prior to attachment to the blank 10 without departing from the disclosure.

The package 1 can be shipped to a user (e.g., a customer) in a flat or collapsed configuration (FIG. 3). In the illustrated embodiment, the package 1 can be positioned to the erected configuration shown in FIGS. 4-6 from the collapsed configuration of FIG. 3 by grasping the side panels 28, 29 and pushing the sides inward at fold lines 26, 27, causing the front panel 21 and back panel 23 to separate or move away from each other to give the package its three dimensional shape and form the interior space 17 of the bag 3 for receiving and/or holding a product. In the erect configuration of the package 1, the lower edge 55 forms the lowermost portion of the bottom 20 of the carton 5 so that the package 1 can be supported on a flat surface and positioned upright in the erect configuration to allow access to the interior space 17 through the top 7 of the bag 3 (FIGS. 4 and 5). As shown in FIGS. 4 and 5, the handles 69 are unfolded from their position as shown in FIG. 3 to extend at the top of the package 1 so that a user can grasp the handles 69 at the openings 71, folding the comfort panels 73 inwardly along the fold lines 75. One or both of the handles 69 can be grasped during use and/or carrying of the package 1 in one embodiment. Alternatively, the upper portions 70, 72 of the side panels 28, 29 could fold inwardly so that the handles 69 are in face-to-face contact and the top of the package 1 is closed without departing from the disclosure.

In one exemplary embodiment, the sealed bottom 9 of the bag 3 can be a water-tight seal that allows a user to add liquid and/or solid products (e.g., human waste products such as urine, solid waste, vomit, etc.) to the interior 17 of the bag of the reinforced package 1. As shown in FIGS. 4 and 5, the open top 7 of the bag 3 extends between the upper portions 70, 72 of the side panels 28, 29 and between the front panel 21 and the back panels 23, 25 above the upper edges 74 of the front panel 21 and the back panels 23, 25. In the illustrated embodiment, the upper portions 70, 72 of the side panels 28, 29 can extend upwardly past the open top 7 of the bag 3 and away from the interior of the carton 5. In addition, as shown in FIGS. 4 and 5, the handles 69 can be positioned in the upper portions 70, 72 above the open top 7 of the bag 3 to facilitate grasping the carton 5 at the handles 69 above the bag 3. In the illustrated embodiment, the products can be received through the open top 7 of the bag 3 at the top of the reinforced package 1 (e.g., while in the erected configuration). Alternatively or in addition, the access feature 57 can be opened by actuating the access flap 65 and removing the access panel 59 along the scores 61, 63 to form an access opening 91 in the front panel 21 (FIG. 5). In one embodiment, the scores 61, 63 can at least partially define an area of weakening wherein the outer surface of the front panel 21 between the scores 61, 63 can separate from the inner portion of the front panel 21 between the scores 61, 63 when the access panel 59 is removed. For example, an outer portion of material of the front panel 21 can tear away from an inner portion of the front panel 21 from the score 63 to the score 61 to remove any clay coating, other coatings or films, and/or a portion of the paperboard substrate adjacent the opening when the access panel 59 is torn away along the scores 61, 63. Accordingly, the removal of the outer portion of material of the front panel 21 with the access panel 59 can leave a softer, crushable rim 93 adjacent the access opening 91. The rim 93 can provide a softer contact area and reduced sharp edges that may contact a user during use.

As shown in FIG. 5, the access opening 91 is aligned with the access aperture 88 in the front section of the bag 3 so that the package 1 can receive products (e.g., waste products) through the access opening 91 into the interior 17 of the bag 3. The access feature 57 can be opened when the reinforced package 1 is in the collapsed configuration (e.g., FIG. 3) or in the erected configuration (e.g., FIG. 5). In one embodiment, the top 7 of the bag 3 could be sealed closed so that the package 1 can receive products only through the access feature 57. The package 1 can be used to hold other types of products without departing from the disclosure. In the flat configuration of the package 1, the carton 5 is folded flat by folding the side panels 28, 29 along fold lines 26, 27.

In one embodiment, the fold lines 51, 26 in the side panel 28 and the fold lines 53, 27 in the side panel 29 can help increase the rigidity of the formed package 1. Also, the fold lines 26, 27, 31, 33, 35, 37, 51, 53 and the V-shaped fold lines 32*a*, 32*b*, 34*a*, 34*b* can be configured to allow the side panels 28, 29 to shape open and remain open. Stated another way, the fold lines 26, 31, 33, 51 and the V-shaped fold lines 32*a*, 32*b* of the first side panel 28 and the fold lines 27, 35, 37, and the V-shaped fold lines 34*a*, 34*b* of the second side panel 29 can help the side panels 28, 29 deform and/or fold inwardly according to a predetermined shape that helps retain the carton 5 in the expanded configuration by resisting forces that would tend to push the panels 28, 29 outwardly and collapse the carton 5. As shown in FIGS. 4-6, each of the side panels 28, 29 can include an upper portion that extends upwardly and outwardly (e.g., away from the interior of the carton 5) from the respective longitudinal fold lines 51, 52 and the respective V-shaped fold lines 32*a*, 32*b* and 34*a*, 34*b*. Accordingly, the side panels 28, 29 can bow inwardly (e.g., at least at the longitudinal fold lines 51, 52) to reinforce the structure of the carton 5 so that the package 1 is urged to stay in the erected configuration once formed.

In the illustrated embodiment, the V-shaped fold lines 32*a*, 32*b*, 34*a*, 34*b* are aligned with the respective arcuate cut portions at the edges of the side panels 28, 29. The cut portions and V-shaped fold lines 32*a*, 32*b*, 34*b*, 34*a* can help to create a relief tension in the side panels 28, 29 that facilitates positioning the package 1 in the open position and resists movement of the side panels 28, 29 from the open position of the package 1 when pressure is applied to the package. As shown in FIGS. 4 and 5, when the package 1 is formed, the arcuate cut portions can form slits or openings in the carton 5 when the side panels 28, 29 are positioned relative to the front panel 21 and back panels 23, 25. The package 1, carton 5, blank 10, and/or bag 3 could have other features, or could be otherwise shaped, arranged, and/or configured without departing from the disclosure.

In one embodiment, the reinforced package 1 can be used as a single-use urinal and/or bedpan replacement (e.g., in a hospital setting). For example, a user (e.g., a hospital patient) can urinate and/or defecate into the interior 17 of the reinforced package 1 via the open top 7 of the bag 3 and/or via the access opening 91 of the access feature 57 (e.g., while grasping the handles 69 or while the package 1 is supported on a surface by the bottom 20). The reinforced package 1 can then hold the waste products until such time that the waste products can be disposed of into an appropriate receptacle. Once emptied, the bag 3 can be separated from the interior of the carton 5 so that the bag 3 and the carton 5 can be placed in the proper recycling streams. In one embodiment, the bag 3 can be run through a macerator prior to recycling. Alternatively, one or more portions of the used package can be macerated and flushed into the sewage system, incinerated, sent to a landfill, or otherwise disposed of. The collapsible, recyclable, single-use reinforced package 1, according to one exemplary embodiment, can have numerous advantages over multi-use and/or molded urinals and bedpans. For example, multi-use urinals and bedpans can spread disease (e.g., by spreading pathogens between patients), whereas the single-use reinforced package 1 is only used by one person. In addition, since the reinforced package 1 can be folded flat, it can stacked into a significantly smaller volume than single-use or multi-use molded urinals and bedpans for storage and or transport (e.g., prior to use).

FIG. 7 is a plan view of a blank 110 for forming a reinforced package 101 (FIGS. 8-12) that includes a bag 3 attached to a carton 105 according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 7, the back panel 123 is similar in size and shape to the front panel 21 and includes a curved edge 124 that extends adjacent the fourth fold line 37 in the carton 105 when the back panel 123 overlaps the attachment flap 125. The back panel 123 and/or the attachment flap 125 could be otherwise arranged, shaped, positioned, and/or configured without departing from the disclosure.

As shown in FIG. 7, the blank 110 includes a first bottom end flap or bottom panel 141 foldably connected to the front panel 21 at a longitudinal fold line 143 and a second bottom end flap 145 foldably connected to the back panel 123 at a longitudinal fold line 147. In the illustrated embodiment, the first bottom end flap 141 includes a longitudinal fold line 149 (e.g., bottom fold line) extending across the width of the bottom end flap 141. In one embodiment, each of the side panels 28, 29 includes a lower edge having a respective support or extension 155 extending therealong. As shown in FIG. 7, each of the front panel 21 and the back panel 123 has a support or extension 177 defined by a cut 179 that extends between respective ends of the respective fold lines 143, 147. As shown in FIGS. 9, 10, and 12, the supports 155, 177 form the bottom 120 of the carton 105 that supports the formed package 101 on a surface in an upright position such that the open top end 7 of the bag 3 is accessible to provide access to the interior 17 of the bag. Any of the bottom end flaps 141, 145 and/or the supports 155, 177 could be omitted or could be otherwise arranged, shaped, positioned, and/or configured without departing from the disclosure.

In one embodiment, the bag 3 can be attached to the carton blank 110 and the carton blank 110 can be folded to form the carton 105 in a similar or identical manner as described above for the first embodiment. For example, the bag 3 can be attached to the front panel 21 so that the access aperture 88 is aligned with the access panel 59 (e.g., as shown in FIG. 11). When the carton blank 110 is folded along the fold line 26, 27 to overlap and glue the back panel 123 and the attachment flap 125, the back panel 123 and/or the attachment flap 125 can be glued to the bag 3 as well. In addition, as shown in FIG. 8, the first bottom end flap 141 can be folded along the longitudinal fold line 149 to overlap the second bottom end flap 145 and the bottom end flaps 141, 145 can be adhesively attached together to form the closed bottom 120 of the carton.

The package 101 is shown in the flat or collapsed configuration as shown in FIG. 8. In the illustrated embodiment, the package 101 can be positioned to the erected configuration shown in FIGS. 9-12 from the collapsed configuration of FIG. 8 by grasping the side panels 28, 29 and pushing the sides inward at fold lines 26, 27, causing the front panel 21 and back panel 123 to separate or move away from each other to give the package its three dimensional shape and form the interior space 17 of the bag 3. As the front panel 21 and the back panel 123 move apart from one another, the first bottom end flap 141 can fold along the longitudinal fold line 149 until the bottom end flaps 141, 145 extend across the bottom 120 of the carton 105 from the front panel 21 to the back panel 123 (FIG. 12). As the bottom end flaps 141, 145 fold to extend across the bottom 120, the bottom end flaps can at least partially separate from the respective front panel 21 and back panel 123 along the respective cut lines 179 to form the respective supports 177. In the erect configuration of the package 101, the supports 155, 177 form the lowermost portion of the bottom 120 so that the package 101 can be supported on a flat surface and positioned upright in the erect configuration to allow access to the interior space 17 through the top 7 of the bag 3 (FIG. 9-11).

The package 101 can be folded back to the flat or collapsed position of FIG. 8 by folding the side panels 28, 29 along fold lines 26, 27 and folding the bottom 120 at fold line 149 in the first bottom end flap 141. In one embodiment, the fold line 149 can fold outwardly, away from the interior of the carton 105 as the carton is folded from the erected position to the collapsed position.

The reinforced package 101 could have other features, or could be otherwise shaped, arranged, and/or configured without departing from the disclosure.

FIG. 13 is a perspective view of a reinforced package 201 formed from a blank (not shown) of a third embodiment of the disclosure. The third embodiment is generally similar to the prior embodiments, except for variations noted and variations that will be apparent to one of ordinary skill in the art. Accordingly, similar or identical features of the embodiments have been given like or similar reference numbers. As shown in FIG. 13, the reinforced package 201 includes a bag 3 and a carton 205, which is similar to the cartons 5, 105 of the prior embodiments, except that the handles 69 are omitted in the carton 205. As shown in FIG. 13, the bag 3 can extend upwardly from the top of the carton 205 so that the sides of the bag 3 can be grasped by a user and/or can be folded downwardly over the outside of the carton 205. The reinforced package 201 could have other features, or could be otherwise shaped, arranged, and/or configured without departing from the disclosure.

Any of the features of the various embodiments of the disclosure can be combined with, replaced by, or otherwise configured with other features of other embodiments of the disclosure without departing from the scope of this disclosure.

Generally, as described herein, liners or bags can be formed from a paper stock material, although various plastic or other liner materials also can be used, and can be lined or coated with a desired material. The constructs, blanks, and/or reinforcing sleeves described herein can be made from a more rigid material such as a clay-coated natural kraft ("CCNK"). Other materials such various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A reinforced package, comprising:

a carton comprising a plurality of panels that extends at least partially around an interior of the carton, the plurality of panels comprising a front panel, a first side panel foldably connected to the front panel along a first fold line, a back panel foldably connected to at least the first side panel along a second fold line, and a second side panel foldably connected to at least one of the front panel and the back panel, the carton comprising a carton opening at a top of the reinforced package;

a bag at least partially attached to the carton at least partially in the interior of the carton, the bag comprising an interior space and an open top end, wherein the open top end of the bag is positioned proximate to the carton opening at the top of the reinforced package; and an access feature for being selectively opened for receiving products into the interior space of the bag, the access feature extending in at least a portion of the carton and in at least a portion of the bag, the access feature comprising an access panel extending in at least the front panel, the access panel being at least partially removable from the front panel for forming an access opening in the carton;

wherein the carton is positionable in a non-erect position wherein the interior space of the bag is at least partially collapsed and in an erect position wherein the interior space of the bag is increased, the carton being configured to support the bag in the erect position, and the first side panel and the second side panel comprise retention features for at least partially retaining the carton in the erect position.

2. The reinforced package of claim 1, wherein the access panel is at least partially separable from the front panel along a line of weakening.

3. The reinforced package of claim 1, wherein the access panel is at least partially separable from the front panel along a first score formed in an exterior surface of the front panel and a second score formed in an interior surface of the front panel, the second score being spaced apart from the first score, the access panel being for at least partially removing an outer portion of material from the front panel between the first score and the second score to form a rim in the front panel, the rim extending along the access opening when the access panel is at least partially removed from the front panel.

4. The reinforced package of claim 3, wherein the access feature further comprises an access flap that is at least partially separable from at least one of the front panel and the access panel along a tear line, the first score and the second score intersecting the tear line.

5. The reinforced package of claim 1, wherein the access feature further comprises an access flap that is at least partially separable from at least one of the front panel and the access panel for initiating removal of the access panel from the front panel.

6. The reinforced package of claim 1, wherein the access feature further comprises an access aperture extending in the bag, the access aperture being at least partially aligned with the access panel.

7. The reinforced package of claim 6, wherein the bag is attached to the front panel and the back panel of the carton, the bag being attached to the front panel at least at locations extending above and below the access panel, between the access panel and the first side panel, and between the access panel and the second side panel.

8. The reinforced package of claim 1, further comprising a handle extending in the carton.

9. The reinforced package of claim 8, wherein the handle comprises a comfort flap foldably connected to the first side panel adjacent a handle opening in the first side panel.

10. The reinforced package of claim 8, wherein the handle is a first handle extending in the first side panel, and the reinforced package further comprises a second handle extending in the second side panel.

11. The reinforced package of claim 10, wherein the first side panel comprises a first upper portion, the second side panel comprise a second upper portion, the first upper portion and the second upper portion extend upwardly past the open top end of the bag in the interior of the carton, and the first handle and the second handle extend in the respective first upper portion and second upper portion above the open top end of the bag.

12. The reinforced package of claim 11, wherein the front panel comprises a first upper edge, the back panel comprises a second upper edge, and the first upper portion of the first side panel and the second upper portion of the second side panel extend upwardly from the first upper edge and the second upper edge.

13. The reinforced package of claim 8, wherein the handle extends in an upper portion of the first side panel, and the upper portion extends away from the interior of the carton from upper edges of the front panel and the back panel.

14. The reinforced package of claim 8, wherein the handle is spaced upwardly from the open top end of the bag.

15. The reinforced package of claim 8, wherein the first side panel comprises a first panel portion foldably connected to a second panel portion along a lateral fold line, and the handle extends in each of the first panel portion and the second panel portion of the first side panel.

16. The reinforced package of claim 1, wherein the retention features comprise at least a V-shaped fold line extending from the first fold line and extending in the first side panel, and the V-shaped fold line comprises a vertex that is spaced apart from the first fold line.

17. The reinforced package of claim 16, wherein the first fold line is arcuate and is concave with respect to the first side panel.

18. The reinforced package of claim 1, wherein the retention features comprise at least a first V-shaped fold line extending from the first fold line and a second V-shaped fold line extending from the second fold line, and each of the first V-shaped fold line and the second V-shaped fold line extends in the first side panel.

19. The reinforced package of claim 18, wherein each of the first fold line and the second fold line is arcuate and is concave with respect to the first side panel.

20. The reinforced package of claim 18, wherein the retention features further comprise a longitudinal fold line extending in the first side panel from a first vertex of the first V-shaped fold line to a second vertex of the second V-shaped fold line, the first side panel comprises a first panel portion foldably connected to a second panel portion along a lateral fold line, and the longitudinal fold line intersects with the lateral fold line.

21. The reinforced package of claim 1, wherein a lower edge of the carton extends along a bottom of the carton for supporting the carton in the erect position, and the bag comprises a closed bottom extending proximate to the bottom of the carton.

22. The reinforced package of claim 1, wherein the carton further comprises a first bottom end flap foldably connected to the front panel and a second bottom end flap foldably connected to the back panel, and the first bottom end flap and the second bottom end flap are at least partially overlapped with respect to one another to at least partially form a bottom of the carton.

23. The reinforced package of claim 22, wherein at least one of the first bottom end flap and the second bottom end flap is at least partially folded along a bottom fold line when the carton is in the non-erect position.

24. The reinforced package of claim 1, wherein the open top end of the bag extends above an upper edge of the front panel, and the access feature further comprises an access aperture extending in the bag, the access aperture being at least partially aligned with the access panel in the front panel of the carton.

25. The reinforced package of claim 24, wherein the access aperture is for being at least partially aligned with the access opening in the carton when the access panel is removed from the front panel.

26. The reinforced package of claim 24, wherein the first side panel comprises a first upper portion, the second side panel comprise a second upper portion, and the first upper portion and the second upper portion extend upwardly past the open top end of the bag in the interior of the carton.

27. The reinforced package of claim 26, wherein a first handle extends in the first upper portion above the open top end of the bag, a second handle extends in the second upper portion above the open top end of the bag, and the first upper portion and the second upper portion are spaced apart from one another by at least the open top end of the bag.

28. The reinforced package of claim 1, wherein the front panel comprises a first upper edge, the back panel comprises a second upper edge, and the first upper edge and the second upper edge are free edges of the carton that at least partially define the carton opening.

29. The reinforced package of claim 28, wherein the first side panel comprises a first upper portion, the second side panel comprise a second upper portion, and the carton opening is at least partially defined between the first upper portion and the second upper portion.

30. In combination, a carton blank and a bag for forming a reinforced package for holding a product:

the carton blank being for forming a carton, the carton blank comprising a plurality of panels comprising a front panel, a first side panel foldably connected to the front panel along a first fold line, a back panel foldably connected to at least the first side panel along a second fold line, and a second side panel foldably connected to at least one of the front panel and the back panel, the carton blank being for at least partially forming a carton opening at a top of the reinforced package formed from the carton blank and the bag;

the bag being at least partially attached to the carton blank, the bag comprising an interior space and an open top end, wherein the open top end of the bag is for being positioned proximate to the carton opening when the carton is formed from the carton blank; and an access feature for being selectively opened for receiving products into the interior space of the bag when the reinforced package is formed from the carton blank and the bag, the access feature extending in at least a portion of the carton blank and in at least a portion of the bag, the access feature comprising an access panel extending in at least the front panel, the access panel being at least partially removable from the front panel for forming an access opening in the carton formed from the carton blank;

wherein the carton formed from the carton blank is positionable in a non-erect position wherein the interior space of the bag is at least partially collapsed and in an erect position wherein the interior space of the bag is increased, and the first side panel and the second side panel comprise retention features for at least partially retaining the carton formed from the carton blank in the erect position.

31. The combination of claim 30, wherein the access panel is at least partially separable from the front panel along a line of weakening.

32. The combination of claim 30, wherein the access panel is at least partially separable from the front panel along a first score formed in an exterior surface of the front panel and a second score formed in an interior surface of the front panel, the second score being spaced apart from the first score, the access panel being for at least partially removing an outer portion of material from the front panel between the first score and the second score to form a rim in the front panel, the rim extending along the access opening when the access panel is at least partially removed from the front panel.

33. The combination of claim 32, wherein the access feature further comprises an access flap that is at least partially separable from at least one of the front panel and the access panel along a tear line, the first score and the second score intersecting the tear line.

34. The combination of claim 30, wherein the access feature further comprises an access flap that is at least partially separable from at least one of the front panel and the access panel for initiating removal of the access panel from the front panel.

35. The combination of claim 30, wherein the access feature further comprises an access aperture extending in the bag, the access aperture being at least partially aligned with the access panel.

36. The combination of claim 35, wherein the bag is attached to the front panel and the back panel of the carton, the bag being attached to the front panel at least at locations extending above and below the access panel, between the access panel and the first side panel, and between the access panel and the second side panel.

37. The combination of claim 30, further comprising a handle extending in the carton blank.

38. The combination of claim 37, wherein the handle comprises a comfort flap foldably connected to the first side panel adjacent a handle opening in the first side panel.

39. The combination of claim 37, wherein the handle is a first handle extending in the first side panel, and the carton blank further comprises a second handle extending in the second side panel.

40. The combination of claim 39, wherein the first side panel comprises a first upper portion, the second side panel comprise a second upper portion, the first upper portion and the second upper portion extend away from the open top end of the bag, and the first handle and the second handle extend in the respective first upper portion and second upper portion and are spaced apart from the bag.

41. The combination of claim 40, wherein the front panel comprises a first upper edge, the back panel comprises a second upper edge, and the first upper portion of the first side panel and the second upper portion of the second side panel extend away from the front panel and the back panel from the first upper edge and the second upper edge.

42. The combination of claim 37, wherein the handle extends in an upper portion of the first side panel, and the upper portion extends away from the interior of the carton from upper edges of the front panel and the back panel when the reinforced package is formed from the carton blank and the bag.

43. The combination of claim 37, wherein the handle is spaced apart from the open top end of the bag.

44. The combination of claim 37, wherein the first side panel comprises a first panel portion foldably connected to a second panel portion along a lateral fold line, and the handle extends in each of the first panel portion and the second panel portion of the first side panel.

45. The combination of claim 30, wherein the retention features comprise at least a V-shaped fold line extending from the first fold line and extending in the first side panel, and the V-shaped fold line comprises a vertex that is spaced apart from the first fold line.

46. The combination of claim 45, wherein the first fold line is arcuate and is concave with respect to the first side panel.

47. The combination of claim 30, wherein the retention features comprise at least a first V-shaped fold line extending from the first fold line and a second V-shaped fold line extending from the second fold line, and each of the first V-shaped fold line and the second V-shaped fold line extends in the first side panel.

48. The combination of claim 47, wherein each of the first fold line and the second fold line is arcuate and is concave with respect to the first side panel.

49. The combination of claim 47, wherein the retention features further comprise a longitudinal fold line extending in the first side panel from a first vertex of the first V-shaped fold line to a second vertex of the second V-shaped fold line, the first side panel comprises a first panel portion foldably connected to a second panel portion along a lateral fold line, and the longitudinal fold line intersects with the lateral fold line.

50. The combination of claim 30, wherein the carton further comprises a first bottom end flap foldably connected to the front panel and a second bottom end flap foldably connected to the back panel, and the first bottom end flap and the second bottom end flap are for being at least partially overlapped with respect to one another to at least partially form a bottom of the carton formed from the carton blank when the reinforced package is formed from the carton blank and the bag.

51. The combination of claim 30, wherein the open top end of the bag is spaced apart from an upper edge of the front panel, and the access feature further comprises an access aperture extending in the bag, the access aperture being at least partially aligned with the access panel in the front panel of the carton.

52. The combination of claim 30, wherein the front panel comprises a first upper edge, the back panel comprises a second upper edge, and the first upper edge and the second upper edge are free edges of the carton blank that at least partially define the carton opening when the carton is formed from the carton blank.

53. The combination of claim 52, wherein the first side panel comprises a first upper portion, the second side panel comprise a second upper portion, and the carton opening is at least partially defined between the first upper portion and the second upper portion.

54. A method of forming a reinforced package, the method comprising:

obtaining a carton blank at least partially attached to a bag, the carton blank comprising a plurality of panels comprising a front panel, a first side panel foldably connected to the front panel along a first fold line, a back panel foldably connected to at least the first side panel along a second fold line, and a second side panel foldably connected to at least one of the front panel and the back panel, and the bag comprising an interior space and an open top end, wherein an access feature extends in at least a portion of the carton blank and in at least a portion of the bag and the access feature comprises an access panel extending in at least the front panel, the access panel being at least partially removable from the front panel for forming an access opening in the front panel;

forming an interior of a carton at least partially defined by the plurality of panels by folding the plurality of panels at least partially around the bag, wherein the carton comprises a carton opening at a top of the reinforced package and the open top end of the bag is positioned proximate to the carton opening at the top of the reinforced package;

wherein the carton is positionable in a non-erect position wherein the interior space of the bag is at least partially collapsed and in an erect position wherein the interior space of the bag is increased, the carton being configured to support the bag in the erect position, and the first side panel and the second side panel comprise retention features for at least partially retaining the carton in the erect position;

wherein the access feature is for being selectively opened for receiving products into the interior space of the bag.

55. The method of claim 54, further comprising at least partially removing the access panel from the front panel to form the access opening in the carton.

56. The method of claim 55, wherein the access panel is at least partially defined by a first score formed in an exterior surface of the front panel and a second score formed in an interior surface of the front panel, the second score being spaced apart from the first score, and the at least partially removing the access panel comprises at least partially removing an outer portion of material from the front panel between the first score and the second score to form a rim in the front panel, the rim extending along the access opening.

57. The method of claim 54, wherein the access feature further comprises an access aperture extending in the bag, the access aperture is at least partially aligned with the access panel, and the bag is attached to the front panel and the back panel of the carton, the bag being attached to the front panel at least at locations extending above and below the access panel, between the access panel and the first side panel, and between the access panel and the second side panel.

58. The method of claim 54, further comprising a handle extending in the carton.

59. The method of claim 58, wherein the handle is a first handle extending in the first side panel, the reinforced package further comprises a second handle extending in the second side panel, the first side panel comprises a first upper portion, the second side panel comprise a second upper portion, the first upper portion and the second upper portion extend upwardly past the open top end of the bag in the interior of the carton, and the first handle and the second handle extend in the respective first upper portion and second upper portion above the open top end of the bag.

60. The method of claim 58, wherein the handle extends in an upper portion of the first side panel, and the upper portion extends away from the interior of the carton from upper edges of the front panel and the back panel.

61. The method of claim 54, wherein the carton further comprises a first bottom end flap foldably connected to the front panel and a second bottom end flap foldably connected to the back panel, and the forming the interior of the carton further comprises at least partially forming a bottom of the carton by at least partially overlapping the first bottom end flap and the second bottom end flap.

62. The method of claim 54, wherein the open top end of the bag extends above an upper edge of the front panel after the forming the interior of the carton, and the access feature further comprises an access aperture extending in the bag, the access aperture being at least partially aligned with the access panel in the front panel of the carton.

63. The method of claim 62, further comprising at least partially removing the access panel from the front panel to form the access opening in the carton, the access aperture being at least partially aligned with the access opening.

64. The method of claim 54, wherein the front panel comprises a first upper edge, the back panel comprises a second upper edge, and the first upper edge and the second upper edge are free edges of the carton that at least partially define the carton opening.

65. The method of claim 64, wherein the first side panel comprises a first upper portion, the second side panel comprise a second upper portion, and the carton opening is at least partially defined between the first upper portion and the second upper portion.

* * * * *